US011742126B2

(12) United States Patent
Ishiwata et al.

(10) Patent No.: US 11,742,126 B2
(45) Date of Patent: Aug. 29, 2023

(54) INDUCTOR

(71) Applicant: TAIYO YUDEN CO., LTD., Tokyo (JP)

(72) Inventors: Shunta Ishiwata, Tokyo (JP); Shinsuke Takeoka, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 471 days.

(21) Appl. No.: 16/831,361

(22) Filed: Mar. 26, 2020

(65) Prior Publication Data

US 2020/0312513 A1 Oct. 1, 2020

(30) Foreign Application Priority Data

Mar. 29, 2019 (JP) ..... 2019-066334

(51) Int. Cl.
*H01F 17/00* (2006.01)
*H01F 27/02* (2006.01)
(Continued)

(52) U.S. Cl.
CPC ..... *H01F 17/0006* (2013.01); *C23C 26/00* (2013.01); *H01F 1/15383* (2013.01);
(Continued)

(58) Field of Classification Search
None
See application file for complete search history.

(56) References Cited

U.S. PATENT DOCUMENTS

2011/0001599 A1* 1/2011 Takenaka ..... H01F 17/0013 336/200
2011/0006247 A1* 1/2011 Katusic ..... C09C 1/22 252/62.59
(Continued)

FOREIGN PATENT DOCUMENTS

JP 10-144526 A 5/1998
JP 10144526 A * 5/1998 ..... H01F 17/00
(Continued)

OTHER PUBLICATIONS

Machine Translation of JP-10144526-A (Year: 1998).*
Machine Translation of JP-2013168648-A (Year: 2013).*
Machine Translation of WO-2016059918-A1 (Year: 2016).*

*Primary Examiner* — Kevin E Yoon
*Assistant Examiner* — Ryan L Heckman
(74) *Attorney, Agent, or Firm* — Pillsbury Winthrop Shaw Pittman, LLP

(57) ABSTRACT

An inductor includes a magnetic base body including soft magnetic metal particles containing iron, first and second external electrodes provided on the magnetic base body, and an internal conductor provided in the magnetic base body, with one end thereof electrically connected to the first external electrode and the other end thereof electrically connected to the second external electrode, the internal conductor extending linearly from the first external electrode to the second external electrode in plan view. The magnetic base body is configured so that a peak intensity ratio is 2 or more between a peak intensity of a first peak and a peak intensity of a second peak in a Raman spectrum obtained by using an excitation laser with a wavelength of 488 nm. The first peak is around a wave number of 712 $cm^{-1}$, and the second peak is around a wave number of 1320 $cm^{-1}$.

14 Claims, 10 Drawing Sheets

(51) Int. Cl.

| | |
|---|---|
| ***H01F 1/24*** | (2006.01) |
| ***C23C 26/00*** | (2006.01) |
| ***H01F 1/153*** | (2006.01) |
| ***H01F 41/04*** | (2006.01) |
| ***H01F 1/18*** | (2006.01) |

(52) U.S. Cl.
CPC ..... *H01F 1/18* (2013.01); *H01F 1/24* (2013.01); *H01F 27/027* (2013.01); *H01F 41/046* (2013.01)

(56) References Cited

U.S. PATENT DOCUMENTS

2012/0080637 A1* 4/2012 Herzog ..... C08K 9/02 977/779
2013/0127576 A1* 5/2013 Hachiya ..... H01F 27/2804 336/200
2013/0214888 A1* 8/2013 Nogi ..... H01F 27/29 336/192
2014/0062636 A1* 3/2014 Yang ..... H01F 17/04 336/83
2014/0370313 A1* 12/2014 Thomas ..... C23C 18/1893 205/159
2015/0213927 A1* 7/2015 Katusic ..... C01G 49/00 427/127
2015/0230810 A1* 8/2015 Creighton ..... A61K 41/0028 604/518
2018/0002779 A1* 1/2018 Lee ..... C22B 1/16
2019/0013127 A1* 1/2019 Maede ..... H01F 27/255

FOREIGN PATENT DOCUMENTS

JP 2013168648 A * 8/2013 ..... H01F 17/00
WO WO-2016059918 A1 * 4/2016 ..... H01F 17/04

* cited by examiner

INDUCTOR

CROSS-REFERENCE TO RELATED APPLICATIONS

This application is based on and claims the benefit of priority from Japanese Patent Application Serial No. 2019-066334 (filed on Mar. 29, 2019), the contents of which are hereby incorporated by reference in their entirety.

TECHNICAL FIELD

The present invention relates to an inductor.

BACKGROUND

As disclosed in Japanese Patent Application Publication No. Hei 10-144526, there is conventionally known an inductor including a magnetic base body made of a ferrite material, a rectangular parallelepiped-shaped internal conductor provided in the magnetic base body, and two external electrodes connected to one end and the other end of the internal conductor, respectively. The internal conductor extends linearly from one of the external electrodes to the other of the external electrodes in plan view. Inductors of this type are used principally for high-frequency circuits. Recent years have seen the growing use of a large electric current in devices and circuits predominantly including electrical components. This has led to an increase in use of a soft magnetic metal material as a material for the magnetic base body of the inductor, the soft magnetic metal material enabling the use of a large electric current. Such a soft magnetic metal material is disadvantageous in that it is inferior in magnetic permeability and withstand voltage characteristic to a ferrite material.

For improvement in performance of an inductor including a magnetic base body made of a soft magnetic metal material, it is required that the magnetic base body used for the inductor have a high magnetic permeability characteristic and be able to achieve a withstand voltage characteristic.

SUMMARY

One object of the present invention is to provide an inductor having a high magnetic permeability and configured to achieve a withstand voltage characteristic. Other objects of the present invention will be made apparent through the entire description of the specification.

An inductor according to one embodiment of the present invention includes a magnetic base body including soft magnetic metal particles containing iron, a first external electrode and a second external electrode provided on the magnetic base body, and an internal conductor provided in the magnetic base body, one end of the internal conductor being electrically connected to the first external electrode and the other end of the internal conductor being electrically connected to the second external electrode, the internal conductor extending linearly from the first external electrode to the second external electrode in plan view. In one embodiment, the magnetic base body is configured so that a peak intensity ratio is 2 or more between a peak intensity of a first peak and a peak intensity of a second peak in a Raman spectrum obtained by using an excitation laser with a wavelength of 488 nm. The first peak is around a wave number of 712 $cm^{-1}$, and the second peak is around a wave number of 1320 $cm^{-1}$. The peak intensity ratio may be set to 70 or more.

The internal conductor may have a rectangular parallelepiped shape. The internal conductor may have an inverted U-shape as viewed sideways.

In one embodiment, the magnetic base body has a rectangular parallelepiped shape including a first principal surface, a second principal surface opposed to the first principal surface, a first end surface connecting the first principal surface to the second principal surface, a second end surface opposed to the first end surface, a first side surface connecting the first principal surface to the second principal surface and connecting the first end surface to the second end surface, and a second side surface opposed to the first side surface. In one embodiment, it is possible that the first external electrode is provided on the first end surface of the magnetic base body, and the second external electrode is provided on the second end surface of the magnetic base body. In another embodiment, the first external electrode and the second external electrode may be provided on the second principal surface of the magnetic base body, the first external electrode being connected to one end of the internal conductor via a first lead conductor, the second external electrode being connected to the other end of the internal conductor via a second lead conductor. In yet another embodiment, the first external electrode and the second external electrode may be provided so as to cover only the second principal surface of the magnetic base body. In still yet another embodiment, it is possible that the first external electrode is provided so as to cover the second principal surface and the first end surface of the magnetic base body, and the second external electrode is provided so as to cover the second principal surface and the second end surface of the magnetic base body.

In one embodiment, in a thickness direction of the magnetic base body perpendicular to the first principal surface, the internal conductor is provided proximate to the first principal surface relative to a midpoint of the magnetic base body in the thickness direction thereof.

In one embodiment, the internal conductor has a length larger than a width thereof, the length extending in a length direction perpendicular to the first end surface, the width extending in a width direction perpendicular to the first side surface, the first lead conductor is provided on an end portion of the internal conductor proximate to the first end surface in the length direction, and the second lead conductor is provided on an end portion of the internal conductor proximate to the second end surface in the length direction.

In one embodiment, a distance between the internal conductor and the second principal surface is larger than a distance between the first lead conductor and the first end surface of the magnetic base body and a distance between the second lead conductor and the second end surface of the magnetic base body.

The inductor in one embodiment includes an insulating film provided between an outer surface of the magnetic base body and each of the first external electrode and the second external electrode.

ADVANTAGES

According to the disclosure of this specification, it is possible to obtain an inductor having a high magnetic permeability characteristic and being able to achieve a withstand voltage characteristic.

DESCRIPTION OF EXAMPLE EMBODIMENTS

By appropriately referring to the appended drawings, the following describes various embodiments of the present invention. Constituent elements common to a plurality of drawings are denoted by the same reference signs throughout the plurality of drawings. It should be noted that the drawings are not necessarily depicted to scale for the sake of convenience of explanation.

Figure 1:
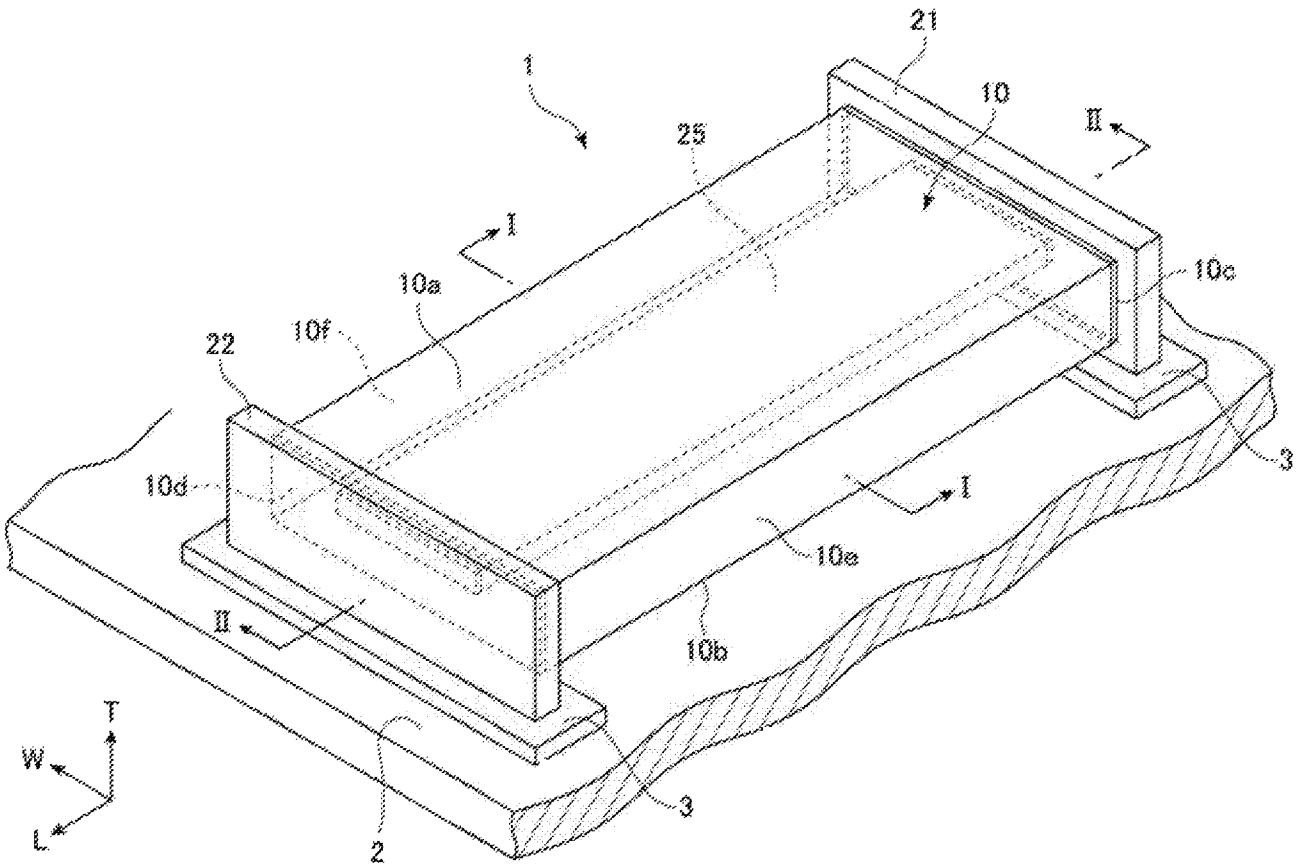
FIG. 1 is a perspective view of an inductor according to one embodiment of the present invention.
Figure 2:
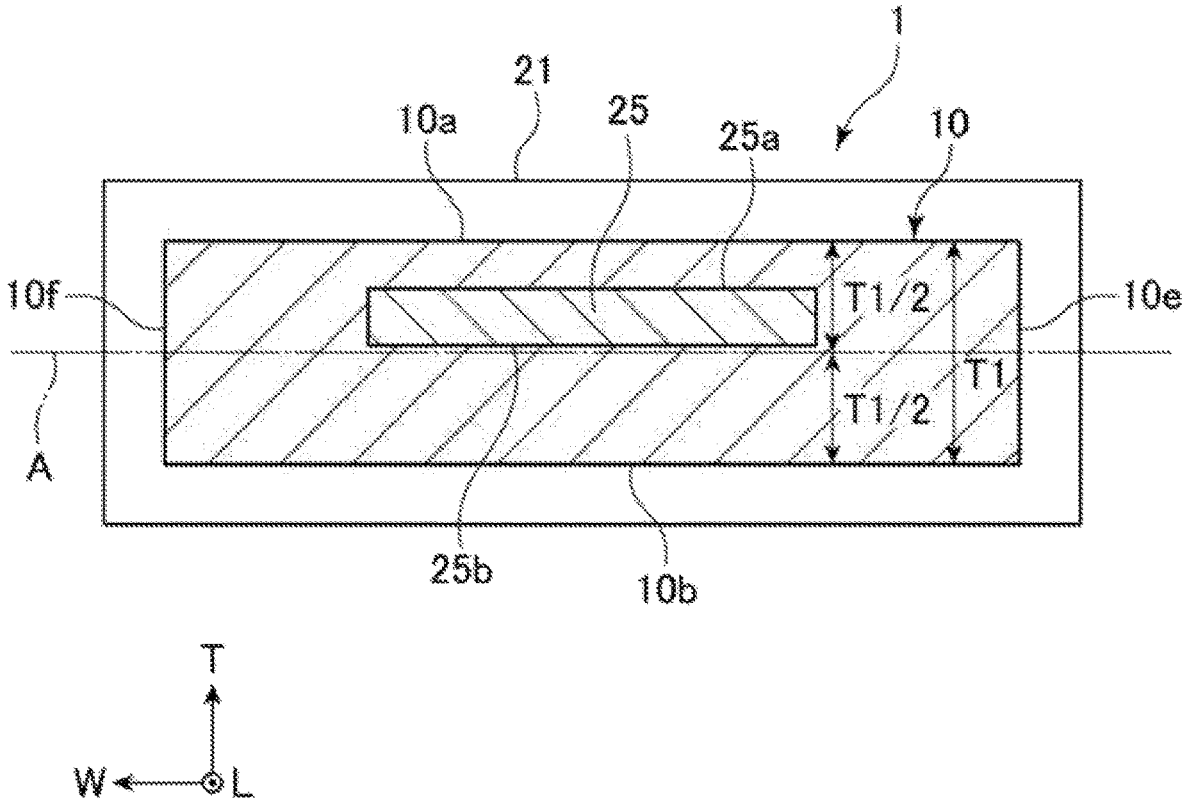
FIG. 2 is a view schematically showing a section of the inductor of FIG. 1 cut along a line I-I.
Figure 3:
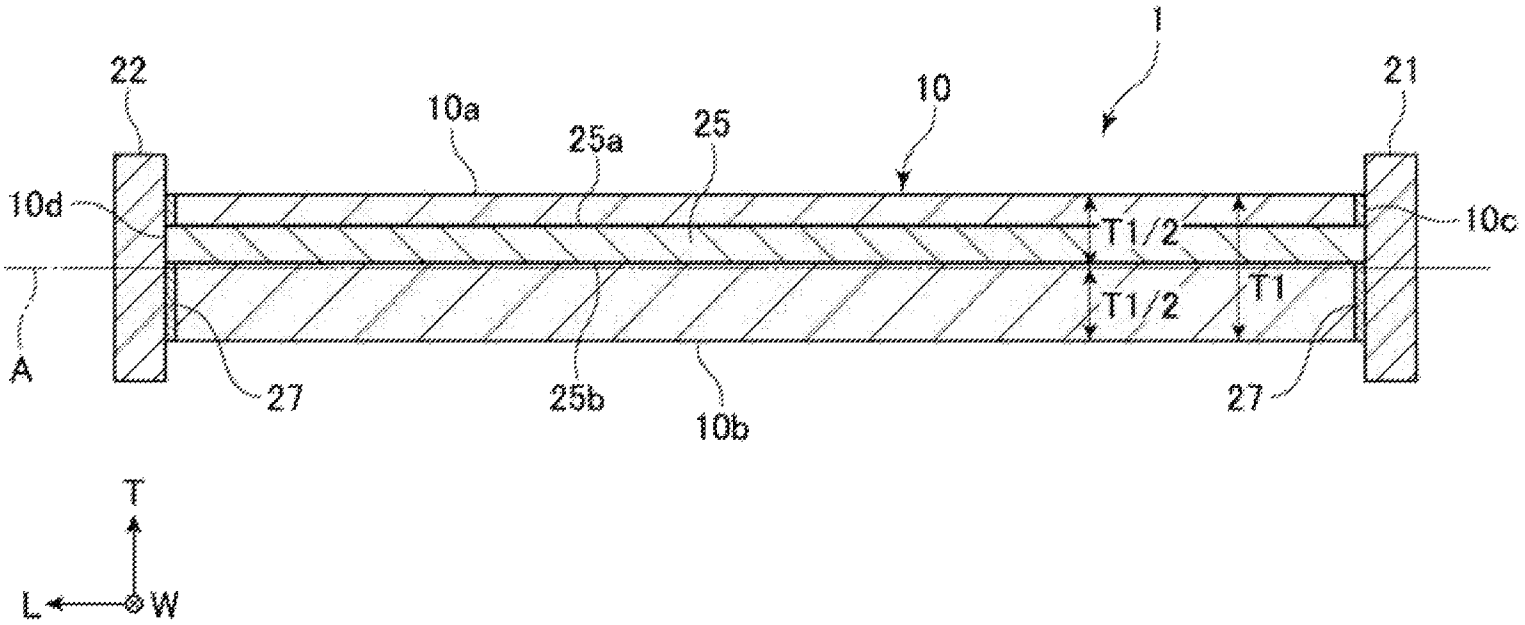
FIG. 3 is a view schematically showing a section of the inductor of FIG. 1 cut along a line II-II.
Figure 4:
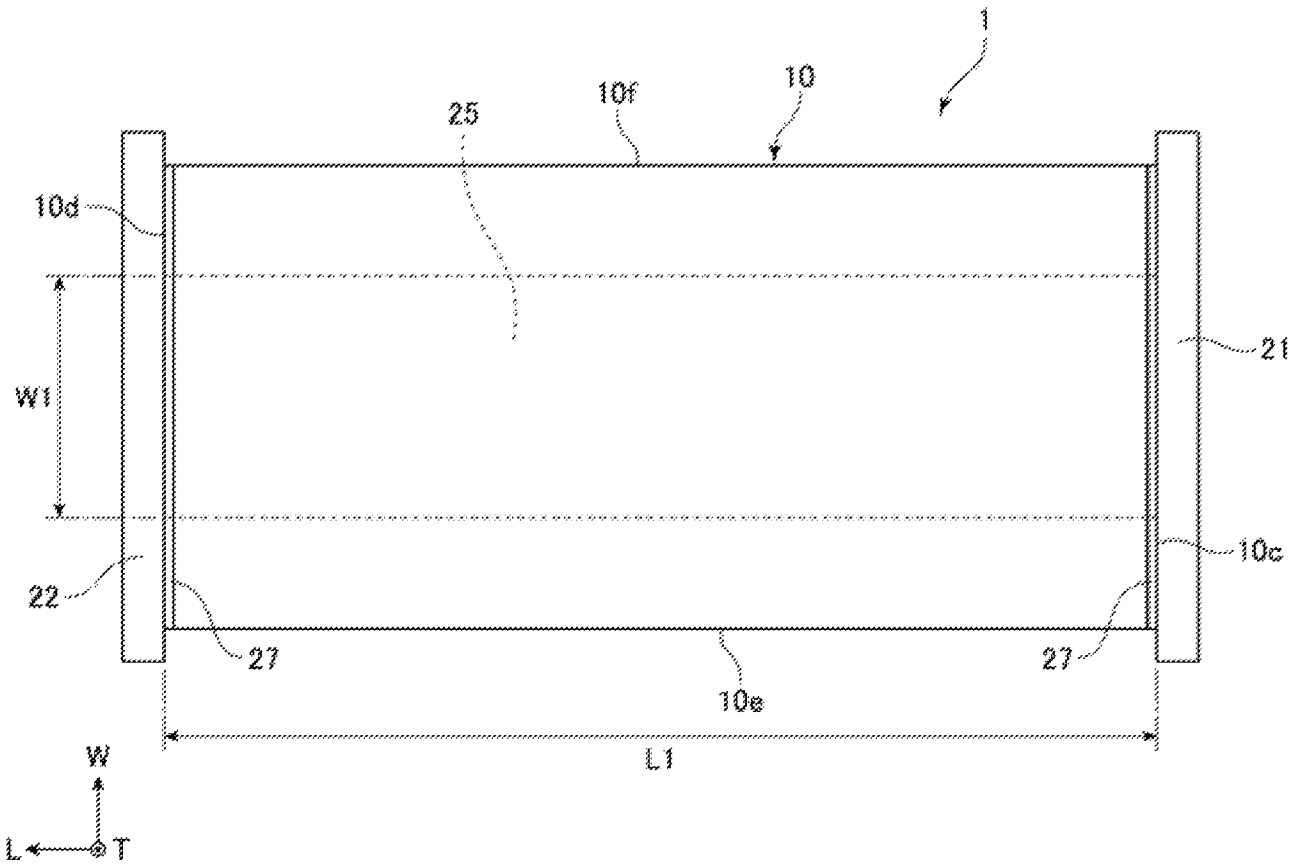
FIG. 4 is a plan view of the inductor of FIG. 1.

An inductor 1 according to one embodiment of the present invention will now be described with reference to FIG. 1 to FIG. 4. FIG. 1 is a perspective view of the inductor 1 according to one embodiment of the present invention, and FIG. 2 is a view schematically showing a section of the inductor 1 cut along a line I-I in FIG. 1. FIG. 3 is a view schematically showing a section of the inductor 1 cut along a line II-II in FIG. 1, and FIG. 4 is a plan view of the inductor 1.

As shown, the inductor 1 includes a magnetic base body 10, an internal conductor 25 provided in the magnetic base body 10, an external electrode 21 electrically connected to one end of the internal conductor 25, and an external electrode 22 electrically connected to the other end of the internal conductor 25. The inductor 1 may include an insulating film 27 provided between the outer surface of the magnetic base body 10 and each of the external electrode 21 and the external electrode 22. The inductor 1 is used in, for example, a large current circuit through which a large electric current flows. The inductor 1 may be used in a signal circuit or a high-frequency circuit. The inductor 1 may be used as a bead inductor, which is used for noise elimination.

The inductor 1 is mounted on a circuit board 2. A land portion 3 may be provided on the circuit board 2. In a case where the inductor 1 includes the two external electrodes 21 and 22, two land portions 3 are provided correspondingly thereto on the circuit board 2. The inductor 1 may be mounted on the circuit board 2 by joining each of the external electrodes 21 and 22 to a corresponding one of the land portions 3 on the circuit board 2. The circuit board 2 can be mounted in various electronic devices. Electronic devices on which the circuit board 2 can be mounted include smartphones, tablets, game consoles, and various other electronic devices. Thus, the inductor 1 can be suitably used for the circuit board 2 on which components are densely mounted. The inductor 1 may be a built-in component embedded in the circuit board 2.

FIG. 1 shows an L axis, a W axis, and a T axis orthogonal to one another. In this specification, a "length" direction, a "width" direction, and a "thickness" direction of the inductor 1 are referred to as an "L" direction, a "W" direction, and a "T" direction in FIG. 1, respectively, unless otherwise construed from the context.

The magnetic base body 10 is made of a magnetic material and formed in a rectangular parallelepiped shape. In one embodiment of the present invention, the magnetic base body 10 is formed to have a length (dimension in the L direction) of 0.4 mm to 10 mm, a width (dimension in the W direction) of 0.2 mm to 10 mm, and a height (dimension in an H direction) of 0.2 mm to 10 mm. The present invention is applicable broadly to various inductors ranging from a relatively small-sized inductor to a relatively large-sized inductor. A top surface and a bottom surface of the magnetic base body 10 may be each covered with a cover layer.

The magnetic base body 10 has a first principal surface 10*a*, a second principal surface 10*b*, a first end surface 10*c*, a second end surface 10*d*, a first side surface 10*e*, and a second side surface 10*f*. The outer surface of the magnetic base body 10 is defined by these six surfaces. The first principal surface 10*a* and the second principal surface 10*b* are opposed to each other, the first end surface 10*c* and the second end surface 10*d* are opposed to each other, and the first side surface 10*e* and the second side surface 10*f* are opposed to each other. Each of the first end surface 10*c* and the second end surface 10*d* connects the first principal surface 10*a* to the second principal surface 10*b* and connects the first side surface 10*e* to the second side surface 10*f*. Each of the first side surface 10*e* and the second side surface 10*f* connects the first principal surface 10*a* to the second principal surface 10*b* and connects the first end surface 10*c* to the second end surface 10*d*. The first principal surface 10*a*, the second principal surface 10*b*, the first end surface 10*c*, the second end surface 10*d*, the first side surface 10*e*, and the second side surface 10*f* of the magnetic base body 10 may be each a flat surface or a curved surface. Furthermore, eight corners of the magnetic base body 10 may be rounded. As described above, even when the first principal surface 10*a*, the second principal surface 10*b*, the first end surface 10*c*, the second end surface 10*d*, the first side surface 10*e*, and the second side surface 10*f* of the magnetic base body 10 are partly curved or the corners of the magnetic base body 10 are rounded, the shape of the magnetic base body 10 may be herein referred to as a "rectangular parallelepiped shape." As described above, a "rectangular parallelepiped" or a "rectangular parallelepiped shape" described herein is not intended to mean a "rectangular parallelepiped" in a mathematically strict sense.

In FIG. 1, since the first principal surface 10*a* lies on a top side of the magnetic base body 10, the first principal surface 10*a* may be referred to as a "top surface." Similarly, the second principal surface 10*b* may be referred to as a "bottom surface." Since the inductor 1 is disposed so that the second principal surface 10*b* is opposed to the circuit board 2, the second principal surface 10*b* may be referred to as a "mounting surface." A top-bottom direction of the inductor 1 refers to a top-bottom direction in FIG. 1. That is, a positive direction of the T axis is referred to as a top direction (or a top side), and a negative direction of the T axis is referred to as a bottom direction (or a bottom side).

In the embodiment shown, the external electrode 21 is provided on the first end surface 10*c* of the magnetic base body 10, and the external electrode 22 is provided on the second end surface 10*d* of the magnetic base body 10. The external electrode 21 and the external electrode 22 are disposed apart from each other in the length direction. In the embodiment shown, the external electrode 21 covers only the first end surface 10*c* in the outer surface of the magnetic base body 10 and does not cover the other five surfaces. Furthermore, in the embodiment shown, the external electrode 22 covers only the second end surface 10*d* in the outer surface of the magnetic base body 10 and does not cover the other five surfaces. Each of the external electrodes 21 and 22 may extend further onto the top surface 10*a* and/or the bottom surface 10*b*. Shapes and arrangements of the external electrodes 21 and 22 are not limited to those shown as an example.

In one embodiment of the present invention, the magnetic base body 10 is formed by bonding a plurality of soft magnetic metal particles to each other. The soft magnetic metal particles included in the magnetic base body 10 are of a soft magnetic alloy containing iron. In one embodiment, the soft magnetic metal particles included in the magnetic base body 10 may be of, for example, an Fe—Si alloy, an Fe—Si—Al alloy, or an Fe—Si—Cr alloy. The soft magnetic metal particles may include only particles of a single type of alloy. The soft magnetic metal particles included in a magnetic material for the magnetic base body 10 may include particles of a plurality of different types of alloys. For example, the soft magnetic metal particles may be mixed particles obtained by mixing a plurality of particles of an Fe—Si alloy and a plurality of particles of an Fe—Si—Al alloy. When the soft magnetic metal particles are of an alloy containing Fe, the content of Fe in the soft magnetic metal particles may be 90 wt % or more. Thus, it is possible to obtain the magnetic base body 10 having a satisfactory magnetic saturation characteristic.

An insulating film may be provided on a surface of each of the soft magnetic metal particles included in the magnetic base body 10. The insulating film can prevent the occurrence of a short circuit between adjacent ones of the soft magnetic metal particles. The insulating film is, for example, an oxide film formed by oxidizing the surface of each of the soft magnetic metal particles. In one embodiment, a coating film may be provided on a surface of the oxide film. The coating film may be, for example, an amorphous silicon oxide film. The amorphous silicon oxide film may be formed on the surface of each of the soft magnetic metal particles by, for example, a coating process using a sol-gel method. The insulating film is preferably formed so as to cover the entire surface of each of the soft magnetic metal particles. The insulating film can be distinguished from the soft magnetic metal particles on the basis of a difference in brightness in a SEM photograph taken by a scanning electron microscope (SEM) at about 10000-fold magnification.

The soft magnetic metal particles included in the magnetic base body 10 may include two or more types of soft magnetic metal particles having different average particle sizes. In one embodiment of the present invention, the magnetic base body 10 may include two types of soft magnetic metal particles having different average particle sizes. The soft magnetic metal particles included in the magnetic base body 10 may have an average particle size of 1 μm to 10 μm. In a case where soft magnetic metal particles having a relatively large average particle size are referred to as first soft magnetic metal particles and soft magnetic metal particles having a relatively small average particle size are referred to as second soft magnetic metal particles, the average particle size of the second soft magnetic metal particles may be one-tenth or less of the average particle size of the first soft magnetic metal particles. When the average particle size of the second soft magnetic metal particles is one-tenth or less of the average particle size of the first soft magnetic metal particles, the second soft magnetic metal particles easily enter between adjacent ones of the first soft magnetic metal particles. Consequently, a filling rate (density) of the soft magnetic metal particles in the magnetic base body 10 can be increased. The average particle size of the soft magnetic metal particles included in the magnetic base body 10 is determined based on a particle size distribution. To determine the particle size distribution, the magnetic base body 10 is cut along the thickness direction (T direction) to expose a cross section, and the cross section is scanned by the scanning electron microscope (SEM) to take a photograph at a 1000-fold to 2000-fold magnification, based on which the particle size distribution is determined. For example, a value at 50 percent of the particle size distribution determined based on the SEM photograph can be set as the average particle size of the soft magnetic metal particles.

As will be described later, in a process of manufacturing the magnetic base body 10, a molded body including soft magnetic metal particles may be subjected to a heat treatment. In this case, an oxide film is formed on a surface of each of the soft magnetic metal particles. The oxide film includes oxides of iron and any other metal element contained in the soft magnetic metal particles. Adjacent ones of the soft magnetic metal particles are bonded to each other via the oxide film. The adjacent ones of the soft magnetic metal particles may be directly bonded to each other without the oxide film interposed therebetween. There may be voids between the adjacent ones of the soft magnetic metal particles. Some or all of the voids may be filled with a resin. In one embodiment of the present invention, the resin contained in the magnetic base body 10 is, for example, a thermosetting resin having an excellent insulation property.

The iron oxides contained in the oxide film formed on the surface of each of the soft magnetic metal particles of the magnetic base body 10 include magnetite ($Fe_3O_4$) and hematite ($Fe_2O_3$). Focusing on the fact that a magnetic permeability improves with an increasing content of magnetite in a magnetic base body, the inventors of the present invention have discovered that the magnetic permeability of the magnetic base body can be adjusted using a ratio between magnetite and hematite in the magnetic base body including soft magnetic metal particles. A magnetic base body of an inductor used for a high-frequency circuit preferably has a magnetic permeability of more than 30 and more preferably has a magnetic permeability of more than 34. The ratio between magnetite and hematite in one embodiment of the present invention is adjusted so that a peak intensity ratio (M/H) is 2 or more in a Raman spectrum obtained by measuring light scattered when the magnetic base body 10 is irradiated with an excitation laser with a wavelength of 488 nm. The peak intensity ratio (M/H) is a ratio of a peak intensity (peak intensity M) of a peak around a wave number of 712 $cm^{-1}$ to a peak intensity (peak intensity H) of a peak around a wave number of 1320 $cm^{-1}$. Furthermore, in the Raman spectrum obtained by measuring the light scattered when the magnetic base body 10 is irradiated with an excitation laser with a wavelength of 488 nm, it is preferable that wustite be not detected (a peak intensity of a peak attributed to wustite be not more than a detection limit of a spectroscopic measurement device used for measurement). By setting the M/H peak ratio to 2 or more, the magnetic permeability of the magnetic base body 10 can be set to 30 or more. In a different embodiment of the present invention, the M/H peak ratio of the magnetic base body 10 is more than 70. By setting the M/H peak ratio to more than 70, the magnetic permeability of the magnetic base body 10 can be set to 34 or more.

The Raman spectrum of the magnetic base body 10 is obtained by irradiating an exposed surface of the magnetic base body 10 with the excitation laser with a wavelength of 488 nm and measuring the light scattered by the magnetic base body 10 with a general spectroscopic measurement device. As the spectroscopic measurement device, for example, a Raman spectrophotometer (NRS-3300) manufactured by JASCO Corporation can be used. The peak around a wave number of 712 $cm^{-1}$ is assigned to magnetite ($Fe_3O_4$), and the peak around a wave number of 1320 $cm^{-1}$ is assigned to hematite ($Fe_2O_3$). A peak assigned to magnetite ($Fe_3O_4$) appears in a range of a wave number of 660 $cm^{-1}$ to 760 $cm^{-1}$ in the Raman spectrum. The "peak around a wave number of 712 $cm^{-1}$" herein refers to a peak with a peak top appearing in the range of a wave number of 660 $cm^{-1}$ to 760 $cm^{-1}$ in the Raman spectrum obtained by using an excitation laser with a wavelength of 488 nm. A peak assigned to hematite ($Fe_2O_3$) appears in a range of a wave number of 1270 $cm^{-1}$ to 1370 $cm^{-1}$ in the Raman spectrum. The "peak around a wave number of 1320 $cm^{-1}$" is a peak assigned to hematite ($Fe_2O_3$) and herein refers to a peak with a peak top appearing in the range of a wave number of 1270 $cm^{-1}$ to 1370 $cm^{-1}$ in the Raman spectrum obtained by using an excitation laser with a wavelength of 488 nm. In the Raman spectrum obtained by measuring the light scattered when the magnetic base body 10 is irradiated with an excitation laser with a wavelength of 488 nm, the peak intensity ratio (M/H), which is a ratio of the peak intensity assigned to magnetite (peak intensity M) to the peak intensity assigned to hematite (peak intensity H), may be herein referred to as the "M/H peak ratio."

The internal conductor 25 is provided in the magnetic base body 10. In the embodiment shown, the internal conductor 25 is exposed at one end thereof to an outside of the magnetic base body 10 through the first end surface 10*c* and is connected to the external electrode 21 at the one end. Furthermore, the internal conductor 25 is exposed at the other end thereof to the outside of the magnetic base body 10 through the second end surface 10*d* and is connected to the external electrode 22 at the other end. In this manner, the internal conductor 25 is connected at one end thereof to the external electrode 21 and connected at the other end thereof to the external electrode 22.

As shown in FIG. 4, the internal conductor 25 extends linearly from the external electrode 21 to the external electrode 22 in plan view (as viewed from the L axis). That is, the internal conductor 25 has no parts that are disposed to be opposed to each other in the magnetic base body 10. Herein, when the internal conductor 25 has no parts that are opposed to each other in the magnetic base body 10 in plan view, it can be said that the internal conductor 25 extends linearly from the external electrode 21 to the external electrode 22. Therefore, in the inductor 1, a level of insulation reliability (withstand voltage) required of the magnetic base body 10 can be lowered compared with that of an inductor including an internal conductor having parts that are opposed to each other. The internal conductor 25 may be disposed on a straight line drawn from the external electrode 21 to the external electrode 22. The internal conductor 25 may include a plurality of conductor portions. All of the plurality of conductor portions extend linearly from the external electrode 21 to the external electrode 22 and are shaped similarly to each other. Each of the plurality of conductor portions has no parts that are disposed to be opposed to each other in the magnetic base body 10. Since the plurality of conductor portions are shaped similarly to each other, among the plurality of conductor portions, there is no difference in potential between such parts that are opposed to each other in the magnetic base body 10. Thus, even in a case where the internal conductor 25 is formed of the above-described plurality of conductor portions, a level of insulation reliability (withstand voltage) required of the magnetic base body 10 is the same as in a case where the internal conductor 25 is formed of a single conductor portion.

In the embodiment shown, the internal conductor 25 has a rectangular parallelepiped shape. As shown in FIG. 4, the internal conductor 25 having a rectangular parallelepiped shape extends linearly from the external electrode 21 to the external electrode 22 in plan view.

In one embodiment, in the thickness direction (T axis direction) of the magnetic base body 10, the internal conductor 25 is provided proximate to the first principal surface 10*a* relative to a midpoint of the magnetic base body 10 in the thickness direction thereof. FIG. 2 and FIG. 3 show the magnetic base body 10 having a thickness T1, and a virtual line A passing through the midpoint of the magnetic base body 10 in the thickness direction and being perpendicular to the T axis is depicted in these drawings. In the embodiment shown, the internal conductor 25, in its entirety, is provided above a virtual plane A passing through the midpoint of the magnetic base body 10 in the thickness direction and being parallel to an LW plane. In a case where the internal conductor 25, in its entirety, is provided above the virtual line A, a bottom surface 25*b* of the internal conductor 25 is provided above the virtual line A. Part of the internal conductor 25 may be provided above the virtual line A passing through the midpoint of the magnetic base body 10 in the thickness direction (i.e., proximate to the first principal surface 10*a*). In a case where part of the internal conductor 25 is provided above the virtual plane A, a top surface 25*a* of the internal conductor 25 is provided above the virtual line A.

In the embodiment shown, the internal conductor 25 is configured so that its length L1 in the length direction is larger than its width W1 in the width direction.

In a case where the insulating film 27 is provided, the insulating film 27 is made of an insulating material having an excellent insulation property. The insulating film 27 has a withstand voltage higher than that of the magnetic base body 10. The insulating film 27 is made of, for example, a resin material having an excellent insulation property.

Subsequently, an illustrative method for manufacturing the inductor 1 according to one embodiment of the present invention will be described. The method for manufacturing the inductor 1 according to one embodiment includes a sheet forming process of forming a magnetic sheet, a conductor forming process of forming a precursor of an internal conductor on the magnetic sheet, and a firing process of firing the magnetic sheet on which the precursor of the internal conductor has thus been formed.

In the sheet forming process, soft magnetic metal particles containing iron are prepared, and slurry is made by kneading the soft magnetic metal particles with a binder. As the binder, there can be used a resin or the like that has excellent thermal decomposability and is easily removable. For example, a butyral resin or an acrylic resin can be used as the binder.

Next, the above-described slurry is compression-molded into a plurality of plate-shaped magnetic sheets. Specifically, the above-described slurry is poured into a mold, and a compacting pressure is applied thereto, so that a plate-shaped molded body is obtained. The above-described compression molding may be performed by warm molding or cold molding. When the warm molding is adopted, the compression molding is performed at a temperature that is lower than a thermal decomposition temperature of the binder and does not affect crystallization of the soft magnetic metal particles. For example, the warm molding is performed at a temperature of 150° C. to 400° C. The compacting pressure is, for example, 40 MPa to 120 MPa. The compacting pressure can be appropriately adjusted to obtain a desired filling rate.

Next, in the conductor forming process, the precursor of the internal conductor is provided on one of the magnetic sheets formed in the above-described manner. The precursor of the internal conductor is provided by, for example, applying a conductive paste on the one of the magnetic sheets by screen printing. In addition to the screen printing, various other known methods can also be used to form the precursor of the internal conductor. Next, on the one of the magnetic sheets on which the precursor of the internal conductor has thus been provided, another one of the magnetic sheets is stacked to form a laminate. The laminate includes the plurality of magnetic sheets and the precursor of the internal conductor provided between the plurality of magnetic sheets. The laminate is formed by, for example, bonding the magnetic sheets to each other by thermal compression. Next, the above-described laminate is segmented by using a cutter such as a dicing machine or a laser processing machine to obtain a chip laminate. End portions of the chip laminate may be subjected to a polishing treatment such as barrel polishing, if necessary.

Once the chip laminate is formed in the above-described manner, the manufacturing method advances to the firing process. In the firing process, the above-described chip laminate is degreased, and the degreased chip laminate is fired to obtain the magnetic base body 10 in which the internal conductor 25 is embedded. The firing process turns the precursor of the internal conductor into the internal conductor 25 and the stacked magnetic sheets into the magnetic base body 10. In the firing process, it is possible that the molded body obtained by a molding step is subjected to a binder removal treatment, and the chip laminate that has thus been subjected to the binder removal treatment is fired. The binder removal treatment may be performed separately from the firing process. The chip laminate is fired in a low oxygen concentration atmosphere containing oxygen in a range of 5 to 3000 ppm at 600° C. to 900° C. for 20 minutes to 120 minutes. By appropriately selecting an oxygen concentration, a heating temperature, a heating time, and any other firing condition as necessary in the firing process, it is possible to obtain an oxide film having a desired M/H ratio. The low oxygen concentration atmosphere used in a heat treatment step contains oxygen in a range of, for example, 1 to 3000 ppm, 3 to 3000 ppm, 5 to 3000 ppm, 10 to 2900 ppm, 20 to 2800 ppm, 30 to 2700 ppm, 40 to 2600 ppm, 50 to 2500 ppm, 60 to 2400 ppm, 70 to 2300 ppm, 80 to 2200 ppm, 90 to 2100 ppm, or 100 to 2000 ppm. Since it may be difficult to keep the oxygen concentration below 50 ppm, the oxygen concentration may be set to 50 ppm or more. The heating temperature in the heat treatment step is 600° C. or higher, 610° C. or higher, 620° C. or higher, 630° C. or higher, 640° C. or higher, 650° C. or higher, 660° C. or higher, 670° C. or higher, 680° C. or higher, 690° C. or higher, or 700° C. or higher. An upper limit of the heating temperature is set to 920° C. or lower, 900° C. or lower, 880° C. or lower, 860° C. or lower, 840° C. or lower, 820° C. or lower, or 800° C. or lower. The heating time is in a range of 20 minutes to 120 minutes. By performing a heat treatment on the chip laminate under the above-described conditions, it is possible to obtain the magnetic base body 10 having a peak intensity ratio (M/H) of 2 or more. The peak intensity ratio (M/H) is a ratio of the peak intensity of the peak around a wave number of 712 $cm^{-1}$, which is assigned to magnetite, to the peak intensity of the peak around a wave number of 1320 $cm^{-1}$, which is assigned to hematite.

Next, a conductor paste is applied to both end portions of the magnetic base body 10 obtained in the above-described manner to form the external electrode 21 and the external electrode 22. Each of the external electrode 21 and the external electrode 22 is provided so as to be electrically connected to one end portion of a coil conductor provided in the magnetic base body 10. In the above-described manner, the inductor 1 is obtained.

Figure 5:
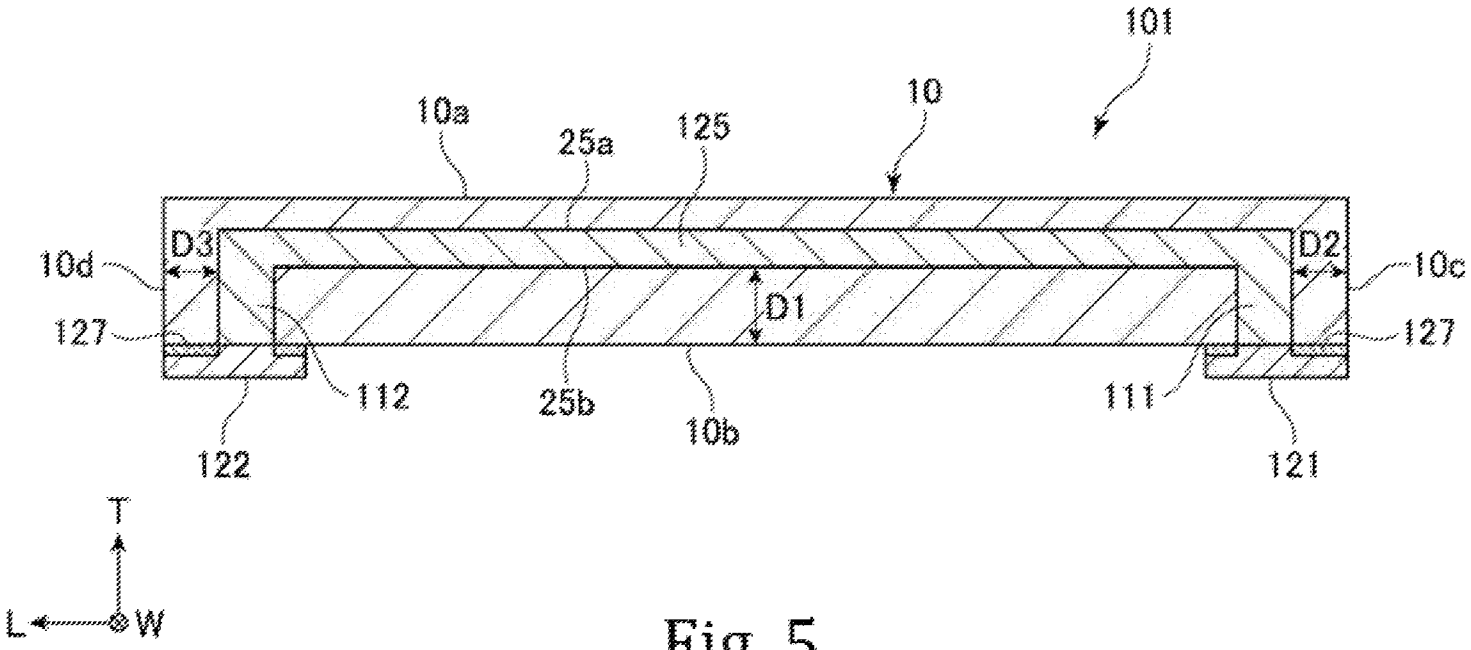
FIG. 5 is a sectional view of an inductor according to another embodiment of the present invention.
Figure 6:
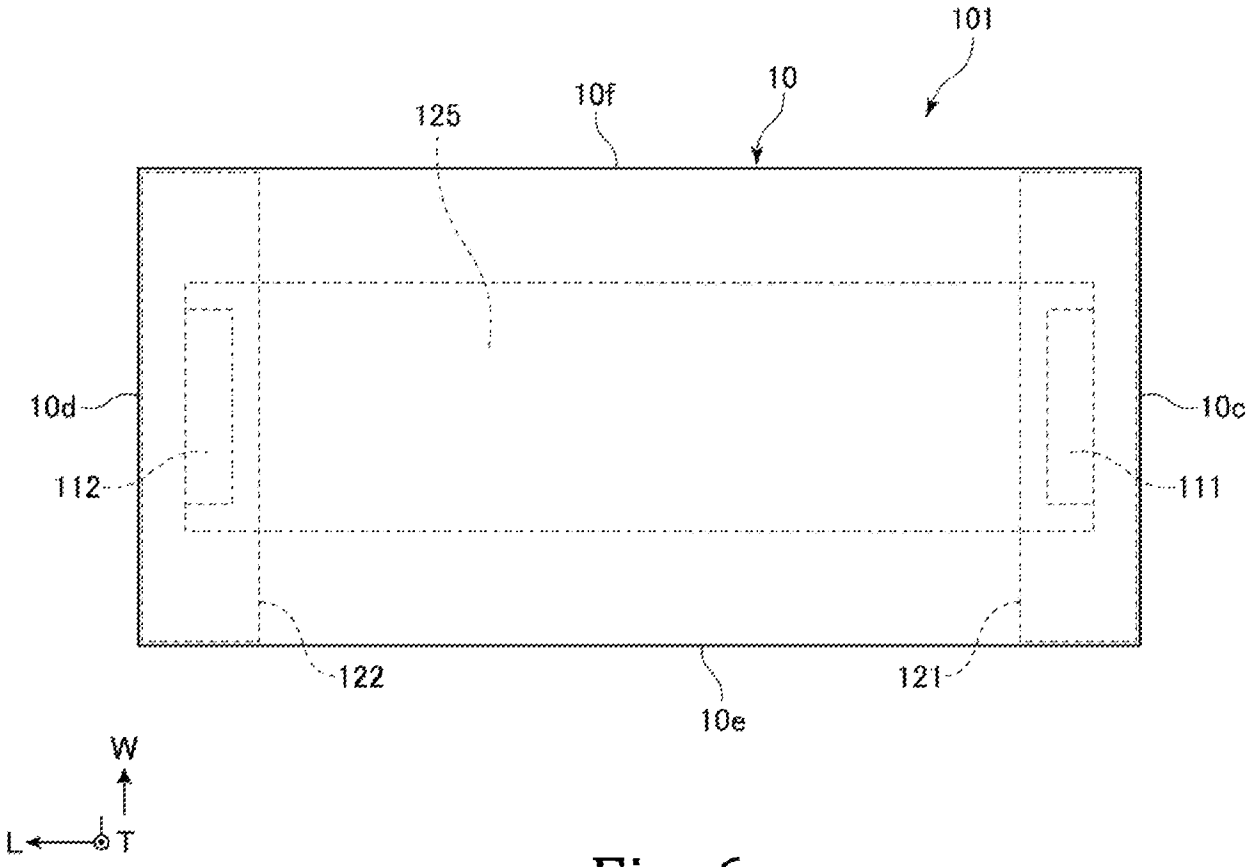
FIG. 6 is a plan view of the inductor of FIG. 5.

Subsequently, an inductor 101 according to another embodiment of the present invention will be described with reference to FIG. 5 and FIG. 6. The inductor 101 shown in FIG. 5 is different from the inductor 1 in that it includes an internal conductor 125 instead of the internal conductor 25 and external electrodes 121 and 122 instead of the external electrodes 21 and 22. The internal conductor 125 is not exposed at both ends thereof in a length direction to an exterior of a magnetic base body 10 through a first end surface 10*c* and a second end surface 10*d*. That is, the internal conductor 125 has a dimension in the L direction (length direction) smaller than a dimension of the magnetic base body 10 in the L direction (length direction). As shown in FIG. 6, the internal conductor 125 extends linearly from the external electrode 121 to the second external electrode 122 in plan view. Similarly to the internal conductor 25, the internal conductor 125, in its entirety, or part of the internal conductor 125 may be provided above a virtual plane passing through a midpoint of the magnetic base body 10 in a thickness direction and being parallel to an LW plane.

The external electrode 121 and the external electrode 122 are provided on a second principal surface (bottom surface) 10*b* of the magnetic base body 10. Therefore, the internal conductor 125 is connected to the external electrode 121 via a lead conductor 111 and connected to the external electrode 122 via a lead conductor 112. An insulating film 127 may be provided between the external electrode 121 and the magnetic base body 10 and between the external electrode 122 and the magnetic base body 10. The insulating film 127 is made of an insulating material having an excellent insulation property. The insulating film 127 has a withstand voltage higher than that of the magnetic base body 10.

The lead conductor 111 extends along the T axis from one end of the internal conductor 125 in the L direction to the bottom surface 10*b* of the magnetic base body 10. The lead conductor 112 extends along the T axis from the other end of the internal conductor 125 in the L direction to the bottom surface 10*b* of the magnetic base body 10. In one embodiment, the internal conductor 125 is provided so that a distance D2 between the lead conductor 111 and the first end surface 10*c* of the magnetic base body 10 and a distance D3 between the lead conductor 112 and the second end surface 10*d* of the magnetic base body 10 are each smaller than a distance D1 between the bottom surface 10*b* of the magnetic base body 10 and a bottom surface 25*b* of the internal conductor 125. Thus, in a case where the internal conductor 125 has fixed dimensions, a mounting area of the inductor 101 can be decreased. Furthermore, in a case where the inductor 101 has fixed dimensions, the internal conductor 125 can be increased in size, and thus an L value of the inductor 101 can be increased.

Figure 7:
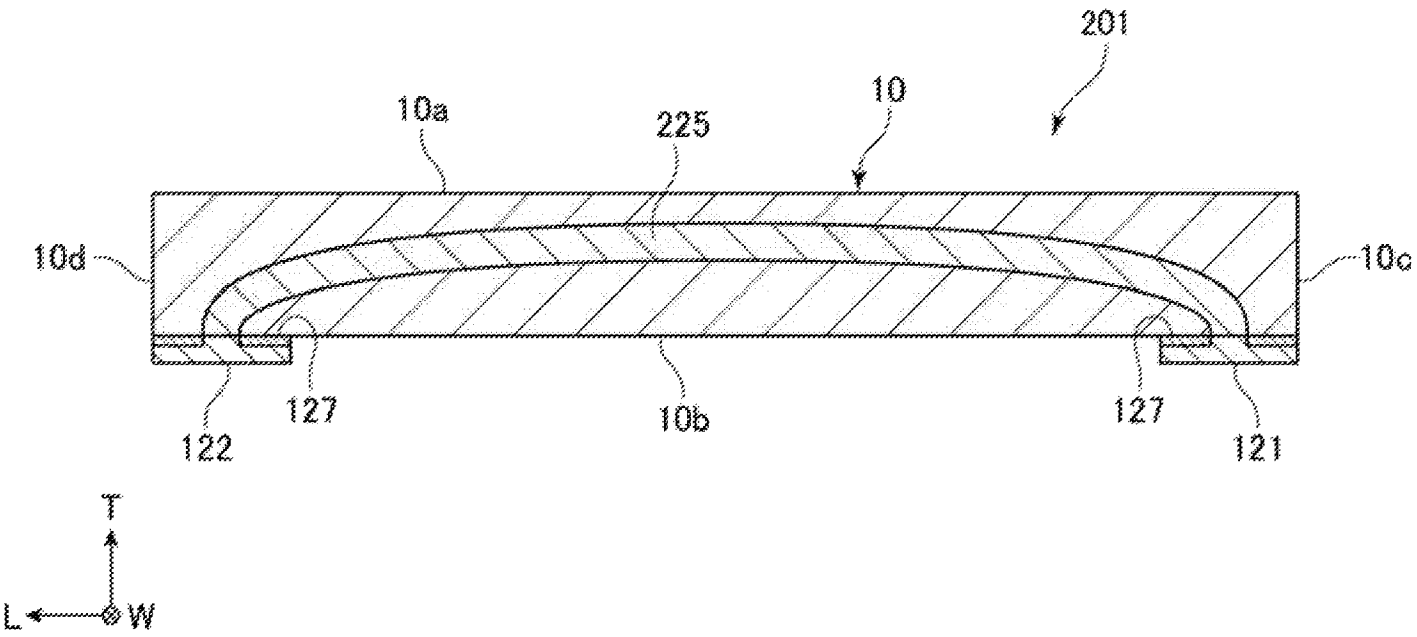
FIG. 7 is a sectional view of an inductor according to yet another embodiment of the present invention.
Figure 8:
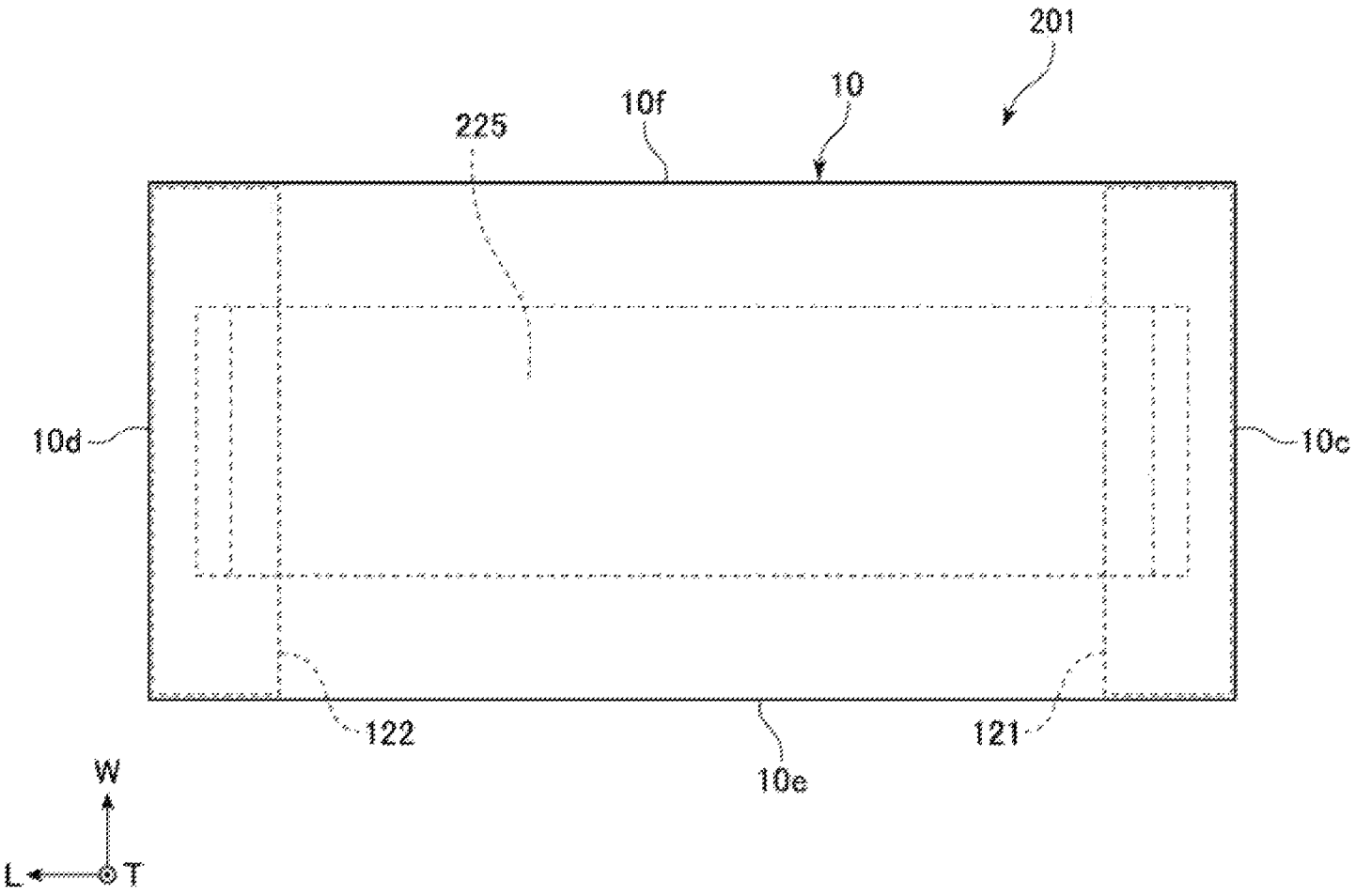
FIG. 8 is a plan view of the inductor of FIG. 7.

Subsequently, an inductor 201 according to yet another embodiment of the present invention will be described with reference to FIG. 7 and FIG. 8. The inductor 201 shown in FIG. 7 is different from the inductor 101 in that it includes, instead of the internal conductor 125, an internal conductor 225 having an inverted U-shape. The internal conductor 225 is connected at one end thereof to an external electrode 121 and connected at the other end thereof to an external electrode 122. As shown in FIG. 8, the internal conductor 225 extends linearly from the external electrode 121 to the external electrode 122 in plan view. An insulating film 127 may be provided between the external electrode 121 and a magnetic base body 10 and between the external electrode 122 and the magnetic base body 10. The insulating film 127 is made of an insulating material having an excellent insulation property. The insulating film 127 has a withstand voltage higher than that of the magnetic base body 10.

Figure 9:
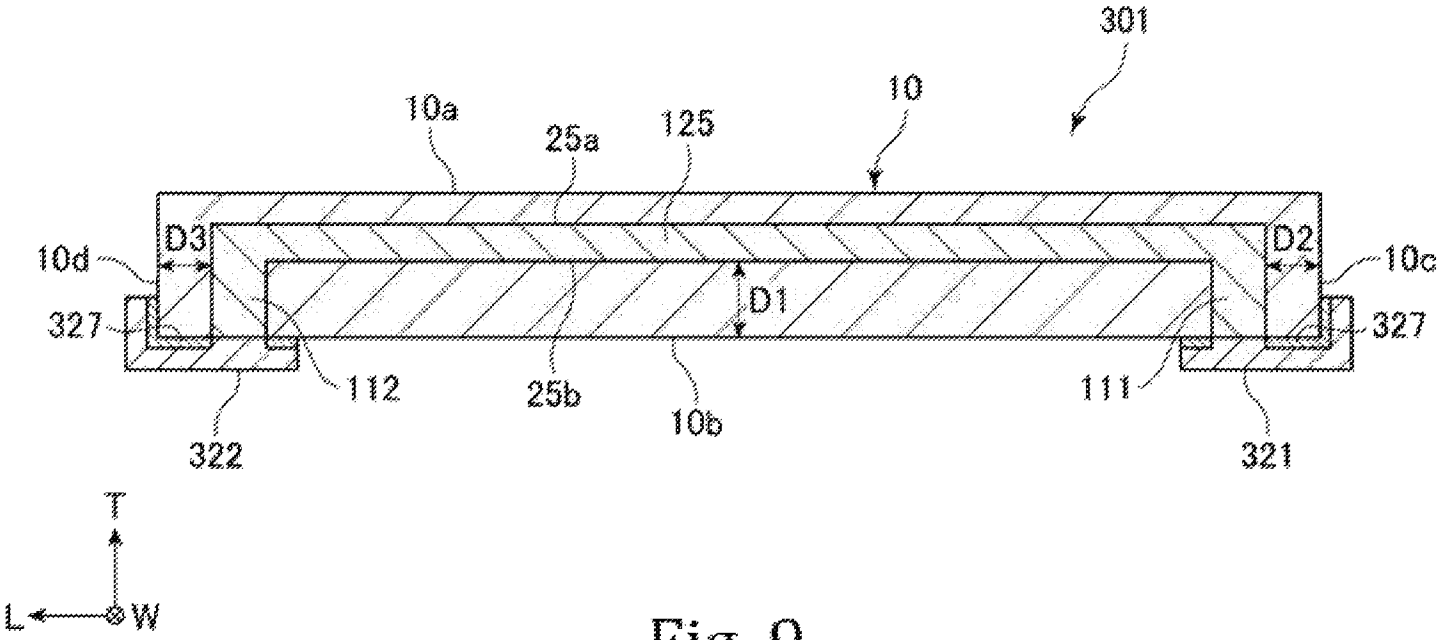
FIG. 9 is a sectional view of an inductor according to still yet another embodiment of the present invention.

Subsequently, an inductor 301 according to still yet another embodiment of the present invention will be described with reference to FIG. 9. The inductor 301 shown in FIG. 9 is different from the inductor 101 in that it includes external electrodes 321 and 322 instead of the external electrodes 121 and 122 and an insulating film 327 instead of the insulating film 127. The external electrode 321 is provided so as to cover a second principal surface 10*b* and a first end surface 10*c* of a magnetic base body 10. The external electrode 322 is provided so as to cover the second principal surface 10*b* and a second end surface 10*d* of the magnetic base body 10. As shown, the external electrode 321 and the external electrode 322 each have an L-shape as viewed in section. The insulating film 327 may be provided between the external electrode 321 and the magnetic base body 10 and between the external electrode 322 and the magnetic base body 10. In order to provide insulation between the magnetic base body 10 and each of the external electrode 321 and the external electrode 322, the insulating film 327 has a shape in conformity to a corresponding one of the external electrode 321 and the external electrode 322. In the embodiment shown, similarly to the external electrode 321 and the external electrode 322, the insulating film 327 has an L-shape as viewed in section. The insulating film 327 is made of an insulating material having an excellent insulation property. The insulating film 327 has a withstand voltage higher than that of the magnetic base body 10.

Figure 10:
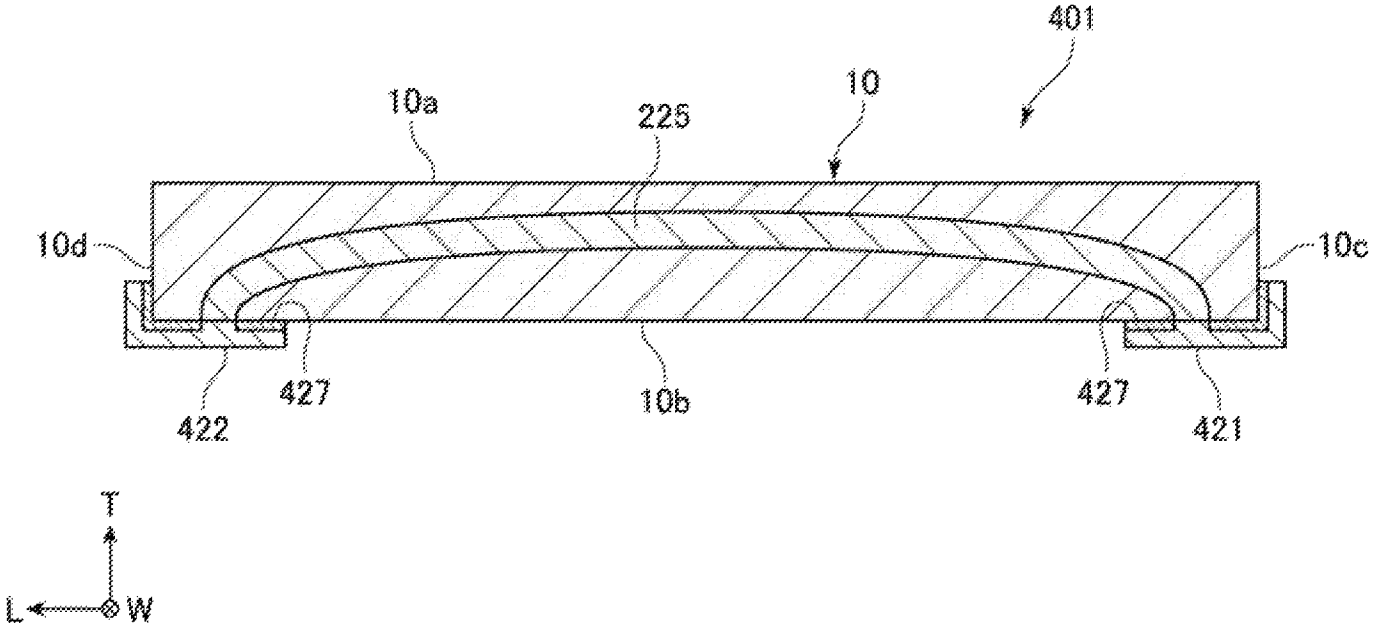
FIG. 10 is a sectional view of an inductor according to even still yet another embodiment of the present invention.

Subsequently, an inductor 401 according to even still yet another embodiment of the invention will be described with reference to FIG. 10. The inductor 401 shown in FIG. 10 is different from the inductor 201 in that it includes external electrodes 421 and 422 instead of the external electrodes 121 and 122 and an insulating film 427 instead of the insulating film 127. The external electrode 421 is provided so as to cover a second principal surface 10*b* and a first end surface 10*c* of a magnetic base body 10. The external electrode 422 is provided so as to cover the second principal surface 10*b* and a second end surface 10*d* of the magnetic base body 10. As shown, the external electrode 421 and the external electrode 422 each have an L-shape as viewed in section. The insulating film 427 may be provided between the external electrode 421 and the magnetic base body 10 and between the external electrode 422 and the magnetic base body 10. In order to provide insulation between the magnetic base body 10 and each of the external electrodes 421 and the external electrode 422, the insulating film 427 has a shape in conformity to a corresponding one of the external electrode 421 and the external electrode 422. In the embodiment shown, similarly to the external electrode 421 and the external electrode 422, the insulating film 427 has an L-shape as viewed in section. The insulating film 427 is made of an insulating material having an excellent insulation property. The insulating film 427 has a withstand voltage higher than that of the magnetic base body 10.

EXAMPLES

Subsequently, examples of the present invention will be described. First, soft magnetic metal particles having a composition of Fe—Si—Cr (Fe: 95 wt %, Si: 3.5%, Cr: 1.5 wt %) were prepared. Subsequently, a particle group of the soft magnetic metal particles and polyvinyl butyral were kneaded to make slurry. Next, the slurry was formed into a long sheet using a coating machine such as a die coater, and the sheet was cut into a plurality of rectangular parallelepiped magnetic sheets each having a thickness of 8 μm. Next, through holes for a via conductor were formed in the thus formed magnetic sheets at predetermined positions thereof. Next, the through holes were filled with a conductive paste containing Ag, and the conductive paste was printed in predetermined patterns on surfaces of one of the magnetic sheets and another one of the magnetic sheets. The magnetic sheets on each of which a conductive pattern had been formed in this manner were stacked so that the conductive patterns formed on the different magnetic sheets were electrically connected via conductors embedded in the through holes. These magnetic sheets were temporarily pressure-bonded at 60° C. to obtain a laminate. There were made sixteen such laminates.

Next, a heat treatment (firing treatment) was performed on the sixteen laminates obtained in the above-described manner. The heat treatment was performed using atmospheres having different oxygen concentrations for the laminates at different heating temperatures for different heating times. Three of the sixteen laminates were heat-treated in atmospheric air, and three others of the sixteen laminates were heat-treated under an extremely low oxygen concentration atmosphere having an oxygen concentration of 3 ppm or less.

Two external electrodes were provided on each of the sixteen laminates that had been subjected to the heat treatment. One of the two external electrodes was connected to one end of the conductive pattern, and the other external electrode was connected to the other end of the conductive pattern. In this manner, sixteen inductors were obtained. Sample numbers from 1 to 16 are assigned to these sixteen inductors. Samples Nos. 1 to 3 correspond to samples that had been heat-treated in the atmospheric air. Samples Nos. 15 and 16 correspond to samples that had been heat-treated under the extremely low oxygen concentration atmosphere.

With respect to each of the sixteen inductors of Samples Nos. 1 to 16 obtained as described above, the Raman spectrum was measured using a Raman spectrophotometer (NRS-3300) manufactured by JASCO Corporation. Specifically, a surface of each of the inductors of Samples Nos. 1 to 16 was irradiated with an excitation laser with a wavelength of 488 nm and light scattered by the each of the inductors was measured using NRS-3300 to obtain sixteen Raman spectra. For the sixteen Raman spectra thus obtained, calculated was the peak intensity ratio (M/H), which is a ratio of the peak intensity (peak intensity M) of the peak exiting at around a wave number of 712 $cm^{-1}$ to the peak intensity (peak intensity H) of the peak around a wave number of 1320 $cm^{-1}$.

Furthermore, magnetic permeability of each of the inductors of Samples Nos. 1 to 16 was measured using a B—H analyzer.

For each of the inductors of Samples Nos. 1 to 16, a voltage at the time of occurrence of a short circuit was measured by increasing a voltage applied between the external electrodes in a stepwise manner. A value obtained by dividing the voltage at the time of occurrence of a short circuit by a distance between the conductive patterns was defined as a withstand voltage of each of the samples.

Table 1 summarizes the peak intensity ratio, the magnetic permeability, and the withstand voltage for each of Samples Nos. 1 to 16 obtained as described above.

TABLE 1

| Sample No. | Peak Intensity Ratio (M/H) | Magnetic Permeability | Withstand Voltage [V/μm] |
|---|---|---|---|
| No. 1 (Comp. Example) | 0.33 | 18 | 2 |
| No. 2 (Comp. Example) | 0.6 | 20 | 1.9 |
| No. 3 (Comp. Example) | 0.93 | 23 | 1.8 |
| No. 4 (Comp. Example) | 1.1 | 26 | 1.8 |
| No. 5 (Comp. Example) | 1.29 | 28 | 1.7 |
| No. 6 (Comp. Example) | 1.47 | 30 | 1.6 |
| No. 7 (Comp. Example) | 1.82 | 32 | 1.6 |
| No. 8 (Example) | 2.01 | 32 | 1.5 |
| No. 9 (Example) | 4.2 | 32 | 1.4 |
| No. 10 (Example) | 5.82 | 32 | 1.4 |
| No. 11 (Example) | 12.2 | 32 | 1.3 |
| No. 12 (Example) | 25.8 | 32 | 1.2 |
| No. 13 (Example) | 52.9 | 33 | 1.1 |
| No. 14 (Example) | 71 | 34 | 1 |
| No. 15 (Example) | 73 | 34 | 0.8 |
| No. 16 (Example) | 81.6 | 34 | 0.05 |
| No. 17 (Example) | 89.2 | 35 | 0.05 |

In an inductor used for a high-frequency circuit, a magnetic base body included therein preferably has a magnetic permeability of more than 30. In an inductor including an internal conductor formed linearly in plan view, however, requirements regarding insulation in a region between parts of the internal conductor are not as strict as in an inductor including a spiral-shaped internal conductor. Having a withstand voltage of less than 1 V/μm, Sample 15 and Sample 16 are conceivably insufficient in terms of insulation resistance in the inductor including the spiral-shaped internal conductor but can be used in the inductor including the internal conductor provided linearly in plan view.

From measurement results shown in Table 1, it has been found that when the M/H peak ratio is 1.82 or more, the magnetic permeability becomes 30 or more, and a certain level of withstand voltage (at least 0.051 V/μm) can be achieved. It has also been found that, conversely, in a case where the M/H peak ratio is 1.47 or less, the magnetic permeability becomes 30 or less. As described above, when the M/H peak ratio of the magnetic base body is 2 or more, there is achieved a high magnetic permeability desirable for the inductor used for a high-frequency circuit. At this time, there is also ensured a certain level of insulation.

Next, advantageous effects of the foregoing embodiments will be described. The inductor 1 according to the above-described embodiment includes the magnetic base body 10 including soft magnetic metal particles containing iron, the external electrode 21 (or the external electrode 121) and the external electrode 22 (or the external electrode 122) provided on the magnetic base body 10, and the internal conductor 25 (or the internal conductor 125 or the internal conductor 225) provided in the magnetic base body 10. One end of the internal conductor is electrically connected to the external electrode 21 (or the external electrode 121) and the other end of the internal conductor is electrically connected to the external electrode 22 (or the external electrode 122). The magnetic base body 10 is configured so that a peak intensity ratio is 2 or more between a peak intensity of a first peak and a peak intensity of a second peak in the Raman spectrum obtained by using an excitation laser with a wavelength of 488 nm. The first peak is around a wave number of 712 $cm^{-1}$, and the second peak is around a wave number of 1320 $cm^{-1}$. This configuration achieves a magnetic permeability of more than 30 desirable for an inductor used for a high-frequency circuit and also provides sufficient insulation for an internal conductor having a rectangular parallelepiped shape.

In a case where there is not sufficient insulation between the internal conductor 25 and each of the external electrodes 21 and 22, the insulating film 27 is provided between the magnetic base body 10 and each of the external electrodes 21 and 22, and thus insulation therebetween can be ensured. The internal conductor 25 has no parts that are opposed to each other in the magnetic base body 10, and thus there is no need to provide an additional member for ensuring insulation between such parts of the internal conductor 25. The same holds true with insulation between the internal conductor 125 and each of the external electrodes 121 and 122.

In the above-described embodiment, in the thickness direction of the magnetic base body 10, each of the internal conductors 25 and 125 is provided proximate to the first principal surface 10*a* relative to the midpoint of the magnetic base body 10 in the thickness direction thereof. Thus, it is possible to improve insulation reliability between a conductive member provided on or built in the circuit board 2 and each of the internal conductors 25 and 125.

The dimensions, materials, and arrangements of the various constituent elements described herein are not limited to those explicitly described in the embodiments, and the various constituent elements can be modified to have any dimensions, materials, and arrangements within the scope of the present invention. Furthermore, constituent elements not explicitly described herein can also be added to the embodiments described, and it is also possible to omit some of the constituent elements described in the embodiments.

What is claimed is:

1. An inductor, comprising:

a magnetic base body including soft magnetic metal particles containing iron;

a first external electrode and a second external electrode provided on the magnetic base body; and an internal conductor provided in the magnetic base body, one end of the internal conductor being electrically connected to the first external electrode, another end of the internal conductor being electrically connected to the second external electrode, the internal conductor extending linearly from the first external electrode to the second external electrode along a first plane, the first plane being perpendicular to a second plane extending along a thickness of the internal conductor, wherein the magnetic base body is configured so that a peak intensity ratio is more than 70 between a peak intensity of a first peak and a peak intensity of a second peak in a Raman spectrum obtained by using an excitation laser with a wavelength of 488 nm, the first peak being around a wave number of 712 $cm^{-1}$, the second peak being around a wave number of 1320 $cm^{-1}$.

2. The inductor according to claim 1, further comprising an insulating film provided between an outer surface of the magnetic base body and each of the first external electrode and the second external electrode.

3. The inductor according to claim 1, wherein the internal conductor has a rectangular parallelepiped shape.

4. The inductor according to claim 1, wherein the magnetic base body has a rectangular parallelepiped shape including a first principal surface, a second principal surface opposed to the first principal surface, a first end surface connecting the first principal surface to the second principal surface, a second end surface opposed to the first end surface, a first side surface connecting the first principal surface to the second principal surface and connecting the first end surface to the second end surface, and a second side surface opposed to the first side surface, wherein the first external electrode is provided on the first end surface of the magnetic base body, and wherein the second external electrode is provided on the second end surface of the magnetic base body.

5. The inductor according to claim 1, wherein the magnetic base body has a rectangular parallelepiped shape including a first principal surface, a second principal surface opposed to the first principal surface, a first end surface connecting the first principal surface to the second principal surface, a second end surface opposed to the first end surface, a first side surface connecting the first principal surface to the second principal surface and connecting the first end surface to the second end surface, and a second side surface opposed to the first side surface, wherein the first external electrode and the second external electrode are provided on the second principal surface of the magnetic base body, wherein the first external electrode is connected to the one end of the internal conductor via a first lead conductor, and wherein the second external electrode is connected to the other end of the internal conductor via a second lead conductor.

6. The inductor according to claim 5, wherein the first external electrode and the second external electrode are provided so as to cover only the second principal surface of the magnetic base body.

7. The inductor according to claim 5, wherein the first external electrode is provided so as to cover the second principal surface and the first end surface of the magnetic base body, and wherein the second external electrode is provided so as to cover the second principal surface and the second end surface of the magnetic base body.

8. The inductor according to claim 5, wherein the internal conductor has a length larger than a width thereof, the length extending in a length direction perpendicular to the first end surface, the width extending in a width direction perpendicular to the first side surface, wherein the first lead conductor is provided on an end portion of the internal conductor proximate to the first end surface in the length direction, and wherein the second lead conductor is provided on an end portion of the internal conductor proximate to the second end surface in the length direction.

9. The inductor according to claim 6, wherein a distance between the internal conductor and the second principal surface is larger than a distance between the first lead conductor and the first end surface of the magnetic base body and a distance between the second lead conductor and the second end surface of the magnetic base body.

10. The inductor according to claim 4, wherein the internal conductor is provided proximate to the first principal surface relative to a midpoint of the magnetic base body in a thickness direction thereof perpendicular to the first principal surface.

11. The inductor according to claim 1, wherein the internal conductor has an inverted U-shape as viewed sideways.

12. The inductor according to claim 11, wherein the magnetic base body has a rectangular parallelepiped shape including a first principal surface, a second principal surface opposed to the first principal surface, a first end surface connecting the first principal surface to the second principal surface, a second end surface opposed to the first end surface, a first side surface connecting the first principal surface to the second principal surface and connecting the first end surface to the second end surface, and a second side surface opposed to the first side surface; and wherein the first external electrode and the second external electrode are provided so as to cover only the second principal surface of the magnetic base body.

13. The inductor according to claim 11, wherein the magnetic base body has a rectangular parallelepiped shape including a first principal surface, a second principal surface opposed to the first principal surface, a first end surface connecting the first principal surface to the second principal surface, a second end surface opposed to the first end surface, a first side surface connecting the first principal surface to the second principal surface and connecting the first end surface to the second end surface, and a second side surface opposed to the first side surface; and wherein the first external electrode is provided so as to cover the second principal surface and the first end surface of the magnetic base body, and wherein the second external electrode is provided so as to cover the second principal surface and the second end surface of the magnetic base body.

14. The inductor according to claim 1, wherein the peak intensity ratio is 89.2 or less.

* * * * *